US009867514B2

(12) United States Patent
VanTongeren

(10) Patent No.: US 9,867,514 B2
(45) Date of Patent: Jan. 16, 2018

(54) VACUUM CLEANER WITH HEIGHT ADJUSTMENT OF SUCTION NOZZLE

(71) Applicant: BISSELL Homecare, Inc., Grand Rapids, MI (US)

(72) Inventor: Todd Richard VanTongeren, Ada, MI (US)

(73) Assignee: BISSELL Homecare, Inc., Grand Rapids, MI (US)

( * ) Notice: Subject to any disclaimer, the term of this patent is extended or adjusted under 35 U.S.C. 154(b) by 0 days.

(21) Appl. No.: 15/418,229

(22) Filed: Jan. 27, 2017

(65) Prior Publication Data

US 2017/0215665 A1 Aug. 3, 2017

Related U.S. Application Data

(60) Provisional application No. 62/288,593, filed on Jan. 29, 2016.

(51) Int. Cl.

| | |
|---|---|
| ***A47L 5/34*** | (2006.01) |
| ***A47L 5/30*** | (2006.01) |
| ***A47L 9/04*** | (2006.01) |
| ***A47L 9/00*** | (2006.01) |

(52) U.S. Cl.

CPC ..... *A47L 5/34* (2013.01); *A47L 5/30* (2013.01); *A47L 9/009* (2013.01); *A47L 9/0072* (2013.01); *A47L 9/0411* (2013.01); *A47L 9/0444* (2013.01); *A47L 9/0477* (2013.01); *A47L 9/0488* (2013.01); *A47L 9/0494* (2013.01)

(58) Field of Classification Search

CPC ..... A47L 5/34; A47L 9/0494; A47L 9/0072; A47L 9/0488; A47L 9/00; A47L 9/04

See application file for complete search history.

(56) References Cited

U.S. PATENT DOCUMENTS

| | | | |
|---|---|---|---|
| 7,487,570 | B2 | 2/2009 | Kim et al. |
| 8,789,235 | B2 | 7/2014 | Krebs et al. |
| 2007/0209144 | A1 | 9/2007 | Fester et al. |
| 2013/0174874 | A1 | 7/2013 | Huffman et al. |
| 2015/0164294 | A1 | 6/2015 | Staf |

*Primary Examiner* — David Redding
(74) *Attorney, Agent, or Firm* — McGarry Bair PC

(57) ABSTRACT

A vacuum cleaner includes a suction nozzle defining a nozzle inlet, a manual nozzle height adjustment assembly for adjusting the height of the nozzle inlet relative to a surface to be cleaned, and a bleed valve fluidly connected to a working air path of the vacuum cleaner to selectively open to reduce suction at the nozzle inlet. The bleed valve is incorporated with the nozzle height adjustment assembly such that movement of the nozzle height adjustment assembly between different height settings will automatically open or close the bleed valve.

20 Claims, 8 Drawing Sheets

VACUUM CLEANER WITH HEIGHT ADJUSTMENT OF SUCTION NOZZLE

CROSS-REFERENCE TO RELATED APPLICATION(S)

This application claims the benefit of U.S. Provisional Patent Application No. 62/288,593, filed Jan. 29, 2016, which is incorporated herein by reference in its entirety.

BACKGROUND

Conventional vacuum cleaners are provided with a vacuum collection system for creating a partial vacuum to suck up debris (which may include dirt, dust, soil, hair, and other debris) from a surface to be cleaned through a suction nozzle and for collecting the removed debris in a space provided on the vacuum cleaner for later disposal. Vacuum cleaners are usable on a wide variety of common household surfaces such as soft flooring including carpets and rugs, and hard or bare flooring, including tile, hardwood, laminate, vinyl, and linoleum.

One type of carpet presently gaining in popularity is "super soft" or "ultra-soft" carpet, which is made up of lower denier fibers that are more densely tufted onto a carpet backing than for conventional carpet types such as "plush", "Berber" or "frieze", for example. Denier is a measurement of weight; more specifically, denier is the weight in grams of 9,000 meters of a filament, fiber or yarn. Typically, a thinner fiber will weigh less and will have a lower denier than a relatively thicker fiber. The denier of a filament of fibers used in a super soft carpet typically ranges from 3.5 to 5, while the nylon filaments of a conventional carpet have a denier of 12 to 18. The combination of low denier fibers and dense tufting gives a super soft carpet a very soft and plush feel, but can also create difficulties with respect to vacuum cleaning since the densely-packed fibers can impede airflow, which can cause the suction nozzle to suck down and become virtually sealed or "locked down" to the super soft carpet. This nozzle "lock down" condition can increase the push force required to move the vacuum cleaner over the carpet. Additionally, the carpet backing typically used with super soft carpet can be nearly impermeable to airflow, which can exacerbate nozzle lock down and further increase the push force.

BRIEF SUMMARY

In one aspect, the invention relates to a vacuum cleaner having a working air path that extends from an air inlet to an air outlet, a suction nozzle having a nozzle inlet defining the air inlet, a suction source configured to generate a working airstream through the working air path, a manual nozzle height adjustment assembly for adjusting the height of the nozzle inlet relative to a surface to be cleaned, and comprising a rotatable knob for manually actuating the nozzle height adjustment assembly to adjust the height of the nozzle inlet relative to a surface to be cleaned, and a bleed valve fluidly connected to the working air path and configured to selectively open to reduce suction at the nozzle inlet, wherein the bleed valve is integrated with the knob of the nozzle height adjustment assembly.

DESCRIPTION OF EMBODIMENTS OF THE INVENTION

The invention generally relates to a vacuum cleaner with a suction nozzle and a mechanism or assembly for adjusting the height of the suction nozzle relative to a surface to be cleaned.

Embodiments of the present invention can incorporate a suction relief or bleed valve feature into a manual nozzle height adjustment assembly on a vacuum cleaner. The vacuum cleaner may be in the form of an upright vacuum cleaner, a hand-held vacuum cleaning device, an autonomous robotic sweeping or vacuum cleaning device, or as an apparatus having a floor nozzle or a hand-held accessory tool connected to a canister or other portable device by a vacuum hose or conduit. Additionally, in some embodiments of the invention the vacuum cleaner can have fluid delivery capability, including applying liquid or steam to the surface to be cleaned, and/or fluid extraction capability.

Examples of a suitable vacuum cleaner in which the various embodiments of the height adjustment mechanism or assembly incorporating a suction relief or bleed valve disclosed herein can be used are disclosed in U.S. Pat. No. 8,789,235, issued Jul. 29, 2014 and U.S. Patent Application Publication No. 2007/0209144, published Sep. 13, 2007, which are incorporated herein by reference in their entirety.

The embodiments of the invention disclosed herein incorporates a low cost relief valve into a height adjust mechanism or assembly that can be selectively actuated to reduce suction at the nozzle, especially to prevent nozzle lock-down on super soft carpets, which can be a problem for existing vacuum cleaners even when adjusted to the highest nozzle carpet height setting. Spring loaded bleed valves have been used in the past to prevent motor damage when the suction nozzle is in a sealed condition, but these simple plunger valves are generally not sensitive enough to accurately relieve pressure in the nozzle area in a nozzle lock down scenario.

Figure 1:
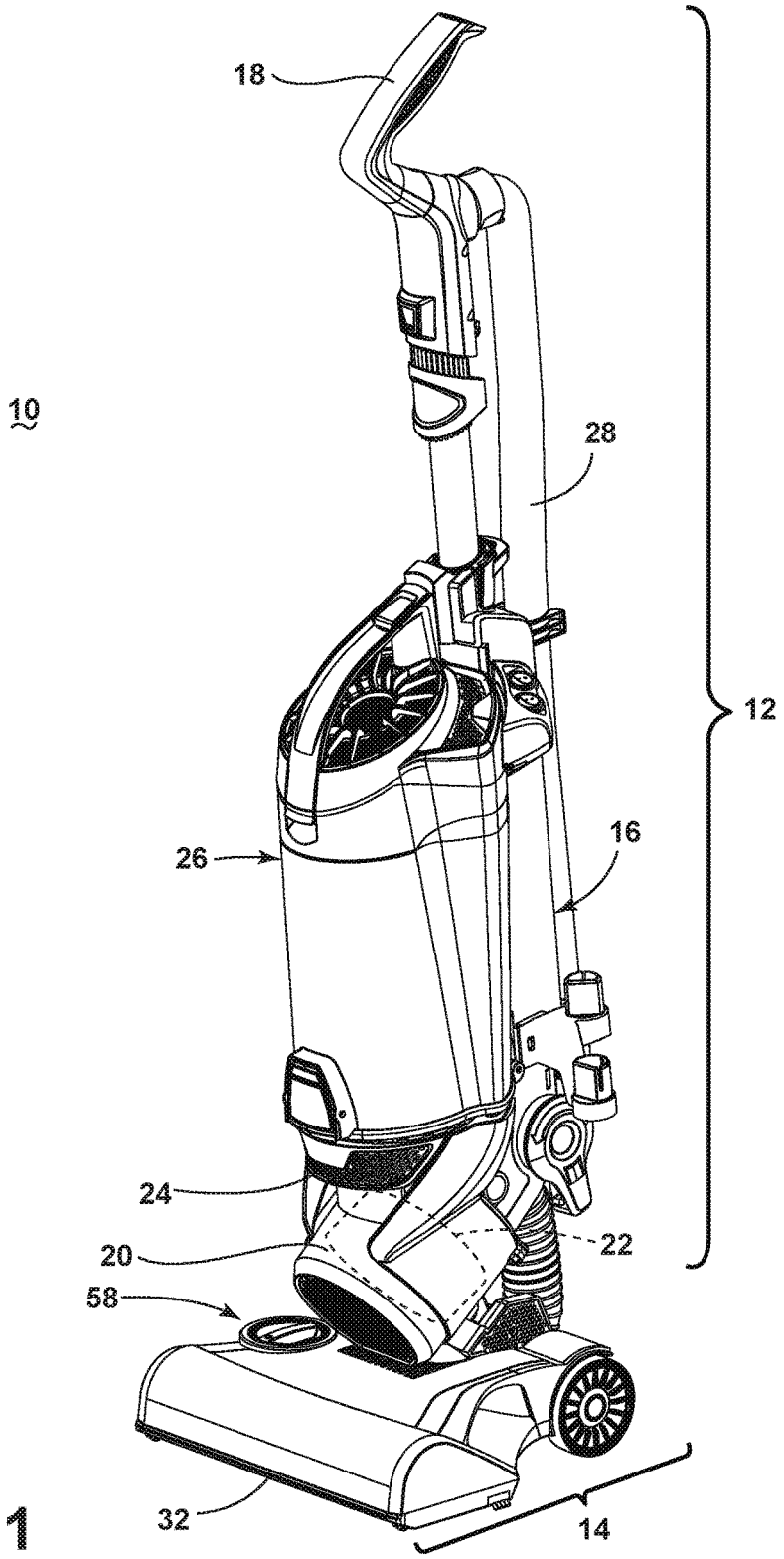
FIG. 1 is a perspective view of an exemplary vacuum cleaner in which a nozzle height adjustment assembly according to one embodiment of the invention may be implemented.

FIG. 1 is a perspective view of an exemplary vacuum cleaner 10 in which a nozzle height adjustment mechanism or assembly according to one embodiment of the invention may be implemented. The vacuum cleaner 10 is an upright-type vacuum cleaner with an upright assembly 12 pivotally mounted to a foot assembly or base 14. In one embodiment, shown in FIG. 1, the height adjustment assembly is provided on the base 14. For purposes of description related to the figures, the terms "upper," "lower," "right," "left," "rear," "front," "vertical," "horizontal," and derivatives thereof shall relate to the invention as oriented in FIG. 1 from the perspective of a user behind the vacuum cleaner 10, which defines the rear of the vacuum cleaner 10. However, it is to be understood that the invention may assume various alternative orientations, except where expressly specified to the contrary. Also, as used herein, the terms "dirt" and "debris" are used interchangeably, and encompass dirt, dust, soil, hair, and other debris.

The upright assembly 12 further comprises a primary support section 16 with a grip 18 on one end to facilitate movement by a user. A suction source cavity 20 is formed at an opposite end of the upright assembly 12 to contain a conventional suction source such as a vacuum fan/motor assembly 22 and which is configured to generate a working airstream through a working air path of the vacuum cleaner that extends from a "dirty" air inlet to a "clean" air outlet. The vacuum fan/motor assembly 22 can form a portion of the working air path. A post-motor filter housing 24 is in fluid communication with the vacuum fan/motor assembly 22, and receives a filter media (not shown) for filtering air exhausted from the vacuum fan/motor assembly 22 before the air exits the vacuum cleaner 10 through the air outlet.

A mounting section on the primary support section 16 of the upright assembly 12 receives a dirt separating and collection assembly 26 for separating dirt and other contaminants from the working airstream. The dirt separating and collection assembly 26 is illustrated herein as comprising a cyclone module comprising a dirt collection chamber and a cyclone separator for separating fluid and entrained dirt from the working airstream. The cyclone separator can have a single cyclonic separation stage, or multiple stages. Dirt separated by the cyclone separator is collected in the dirt collection chamber. It is understood that other types of dirt separating and collection assemblies can be used, such as centrifugal separators or bulk separators. In yet another conventional arrangement, the dirt separating and collection assembly can comprise a filter bag. Regardless of its particular configuration, the dirt separating and collection assembly 26 can form a portion of the working air path through the vacuum cleaner 10.

At least a portion of the working air path leading to the dirt separating and collection assembly 26 can be formed by a vacuum hose 28. One end of the vacuum hose 28 can be selectively disconnected from the vacuum cleaner 10 for above-the-floor cleaning, while the other end remains in fluid communication with the dirt separating and collection assembly 26.

Figure 2:
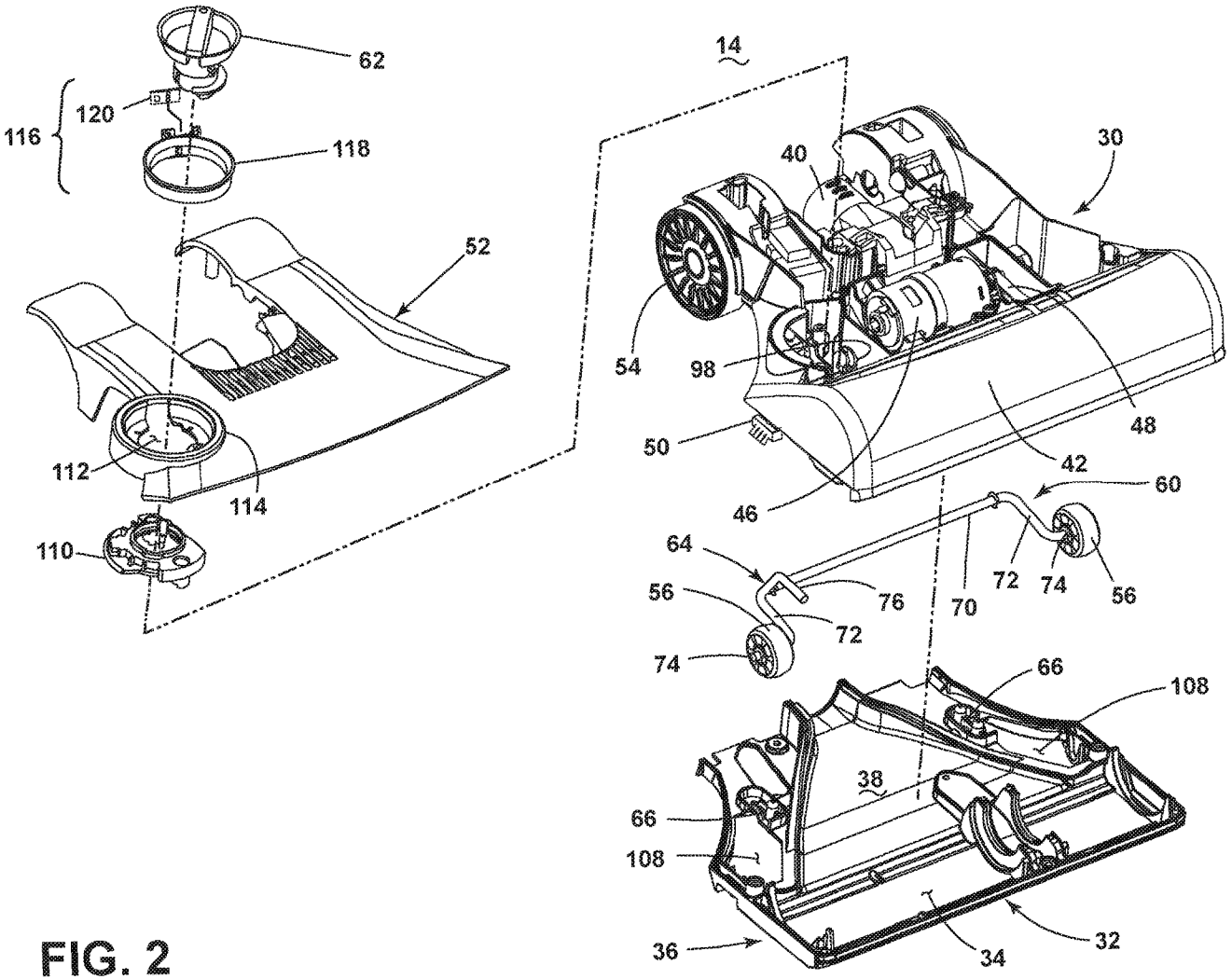
FIG. 2 is an exploded view of a base of the vacuum cleaner shown in FIG. 1, illustrating features of the nozzle height adjustment assembly.
Figure 3:
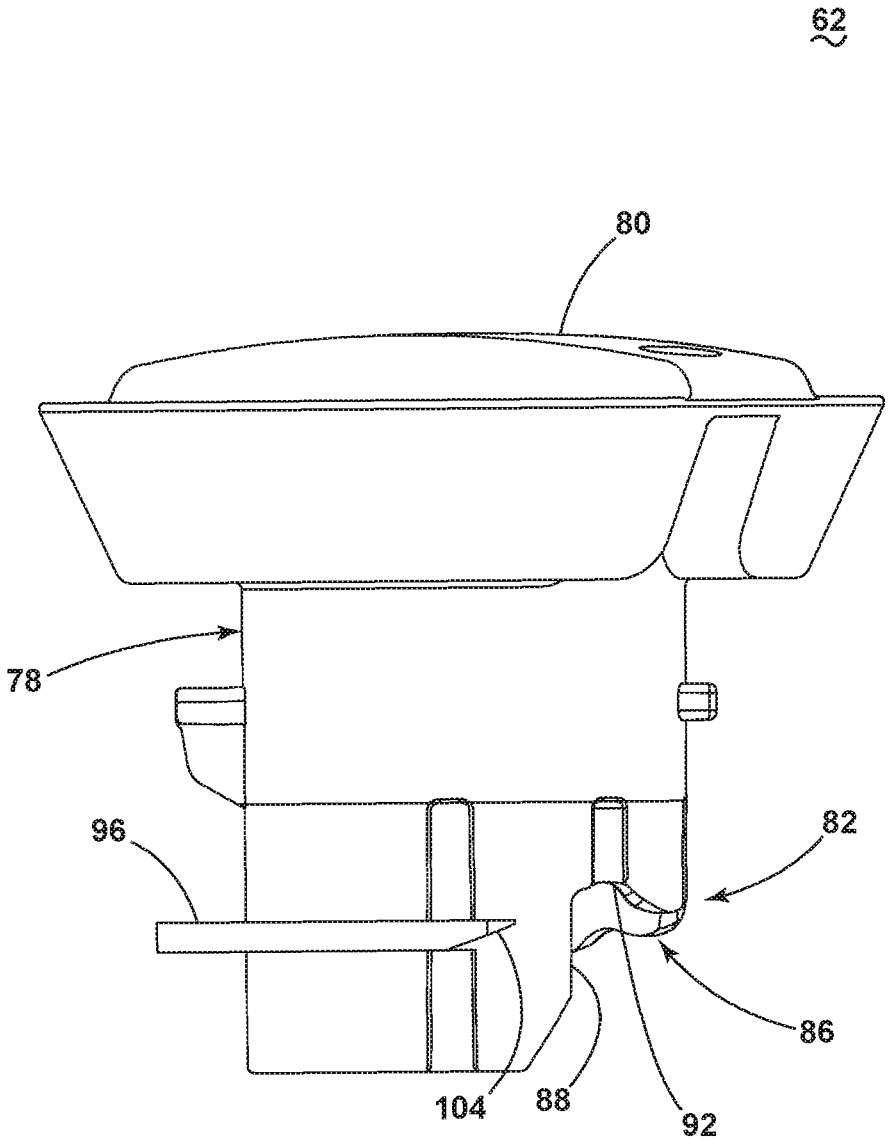
FIG. 3 is a side view of a knob of the nozzle height adjustment assembly.
Figure 4:
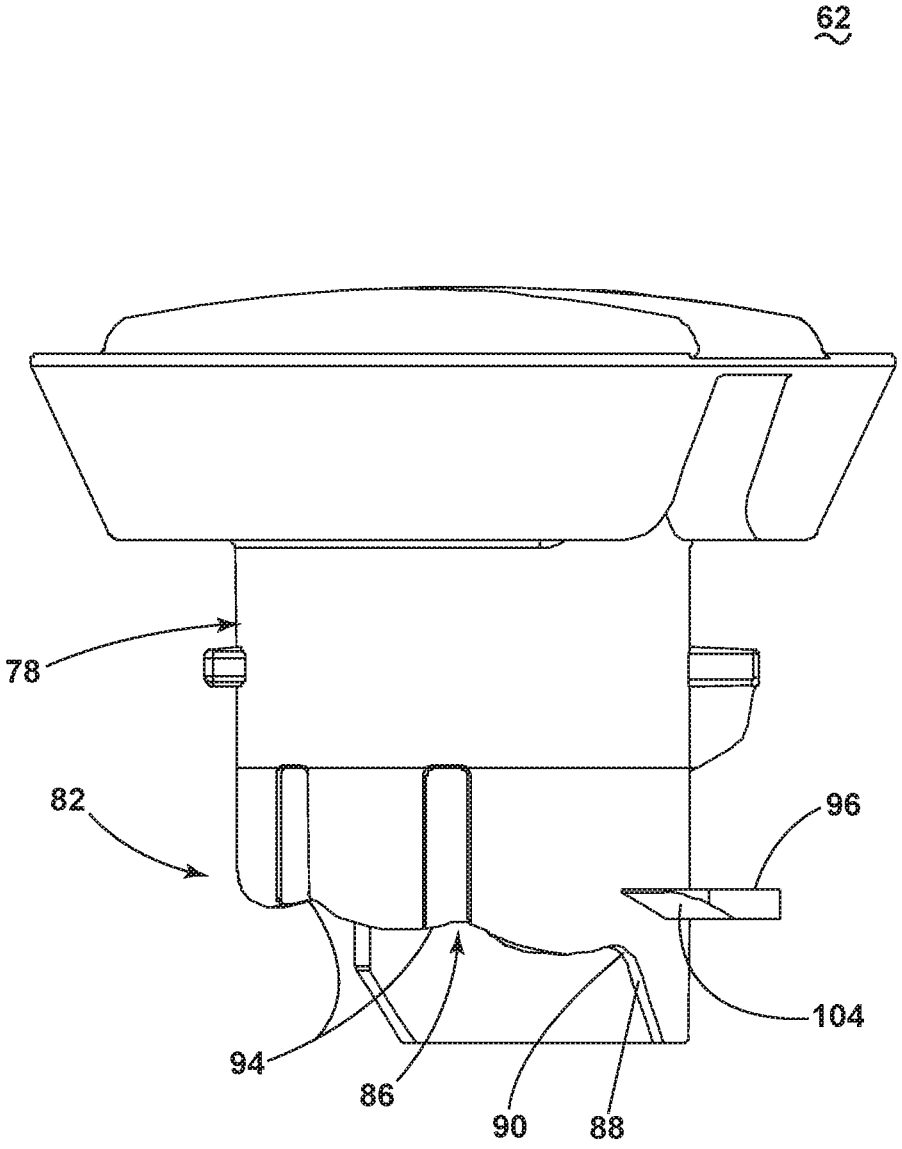
FIG. 4 is a side view opposite the side view shown in FIG. 3 of the knob of the nozzle height adjustment assembly.

FIG. 2 is an exploded view of the base 14 of the vacuum cleaner 10 shown in FIG. 1, illustrating features of the nozzle height adjustment assembly. The base 14 comprises a base housing 30 with a suction nozzle 32 formed at a lower surface thereof and that is in fluid communication with the vacuum fan/motor assembly 22 (FIG. 1). The suction nozzle 32 includes a nozzle inlet 34 provided in a sole plate 36 and defining the air inlet of the working air path. A suction channel 38 extends from the nozzle inlet 34 and can progressively narrow to couple with a base conduit 40 in fluid communication with the vacuum hose 28 (FIG. 1), with the suction channel 38 and the base conduit 40 forming a portion of the working air path between the suction nozzle 32 and the dirt separating and collection assembly 26.

The base housing 30 mates with the sole plate 36 to form an agitator chamber 42 therebetween. The agitator chamber 42 contains an agitator, such as a brushroll 44, and is provided adjacent to the nozzle inlet 34. The brushroll 44 is operably connected to a dedicated agitator motor 46 via a stretch belt 48. Alternatively, the brushroll 44 can be operably connected to the vacuum fan/motor assembly 22 (FIG. 1). Additional agitators in the form of edge brushes 50 can optionally be provided on the housing 30.

The base housing 30 also mates with a cover housing 52 which encloses the agitator motor 46 and other components of the base 14. Rear wheels 54 are secured to a rearward portion of the base 14 and front wheels 56 are secured to the base 14 forwardly of the rear wheels 54 for moving the base 14 over a surface to be cleaned.

A nozzle height adjustment mechanism or assembly 58 is provided on the base 14 for adjusting the height of the suction nozzle 32 relative to a surface to be cleaned. The height adjustment assembly 58 further incorporates a suction relief or bleed valve feature that can be selectively opened to reduce suction at the nozzle inlet 34.

The height adjustment assembly 58 can include a wheeled carriage 60 that carries the front wheels 56, and which lifts and lowers the front end of the base 14, and therefore the nozzle inlet 34 and the agitator 44, relative to the surface to be cleaned. A rotatable knob 62 for actuating the height adjustment assembly 58 can be provided on the exterior of the base 14, such that it is accessible by a user of the vacuum cleaner 10. Specifically, the knob 62 can be provided on a top side of the base 14, such that the user can access the knob with the vacuum cleaner 10 in its normal operating position. Details of a suitable height adjustment assembly can be found in U.S. Patent Application Publication No. 2007/0209144, published Sep. 13, 2007, which is incorporated herein by reference in its entirety. The knob 62 can be rotated to raise and lower the nozzle inlet 34 and agitator 44 in the agitator chamber 42 through a variety of height settings by rotating the carriage 60 to move the front wheels 56 closer to or further from the bottom of the base 14, i.e. the sole plate 36.

Figure 5:
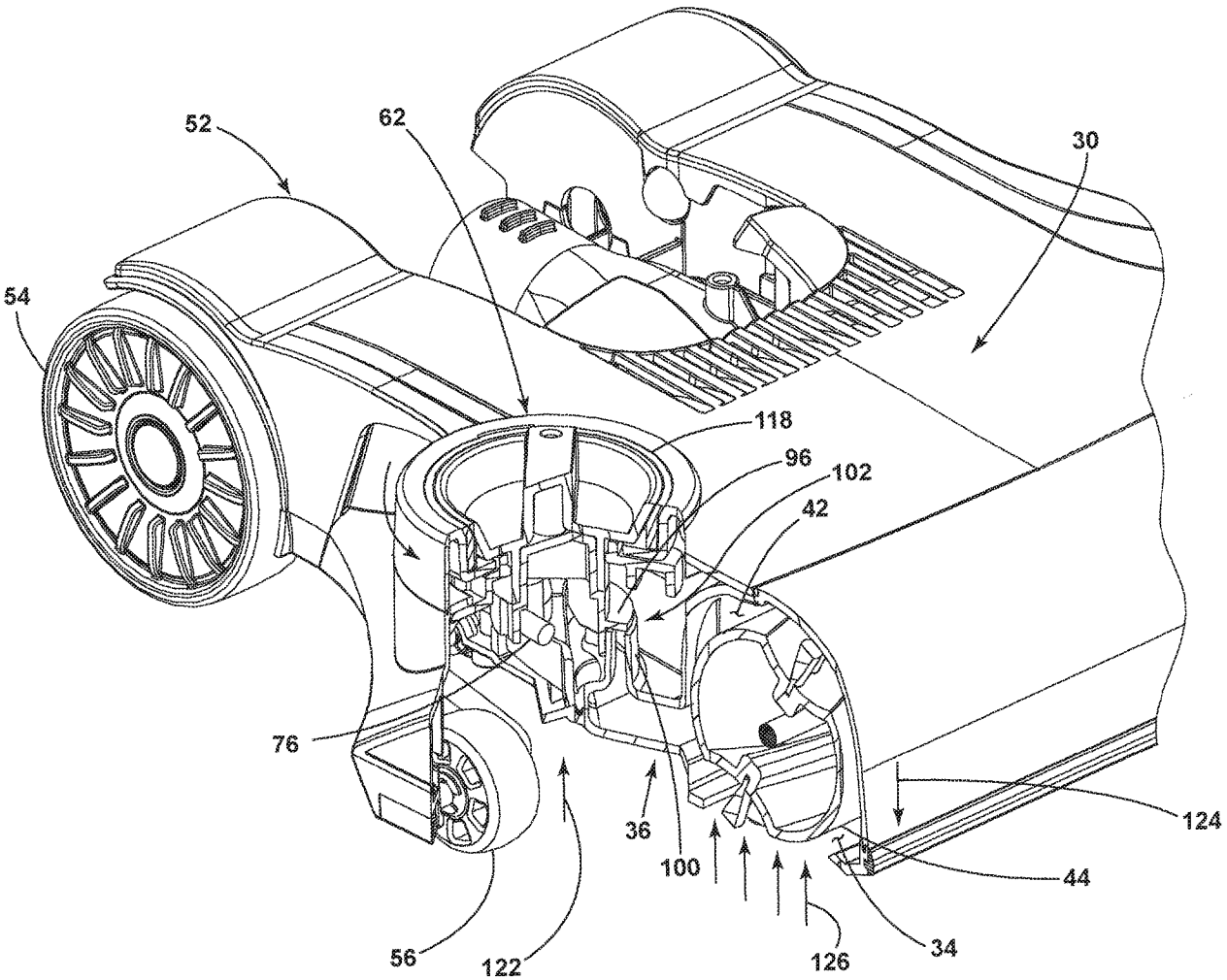
FIG. 5 is a partial cutaway view through the nozzle height adjustment assembly in the base, with a bleed valve in a closed position.
Figure 6:
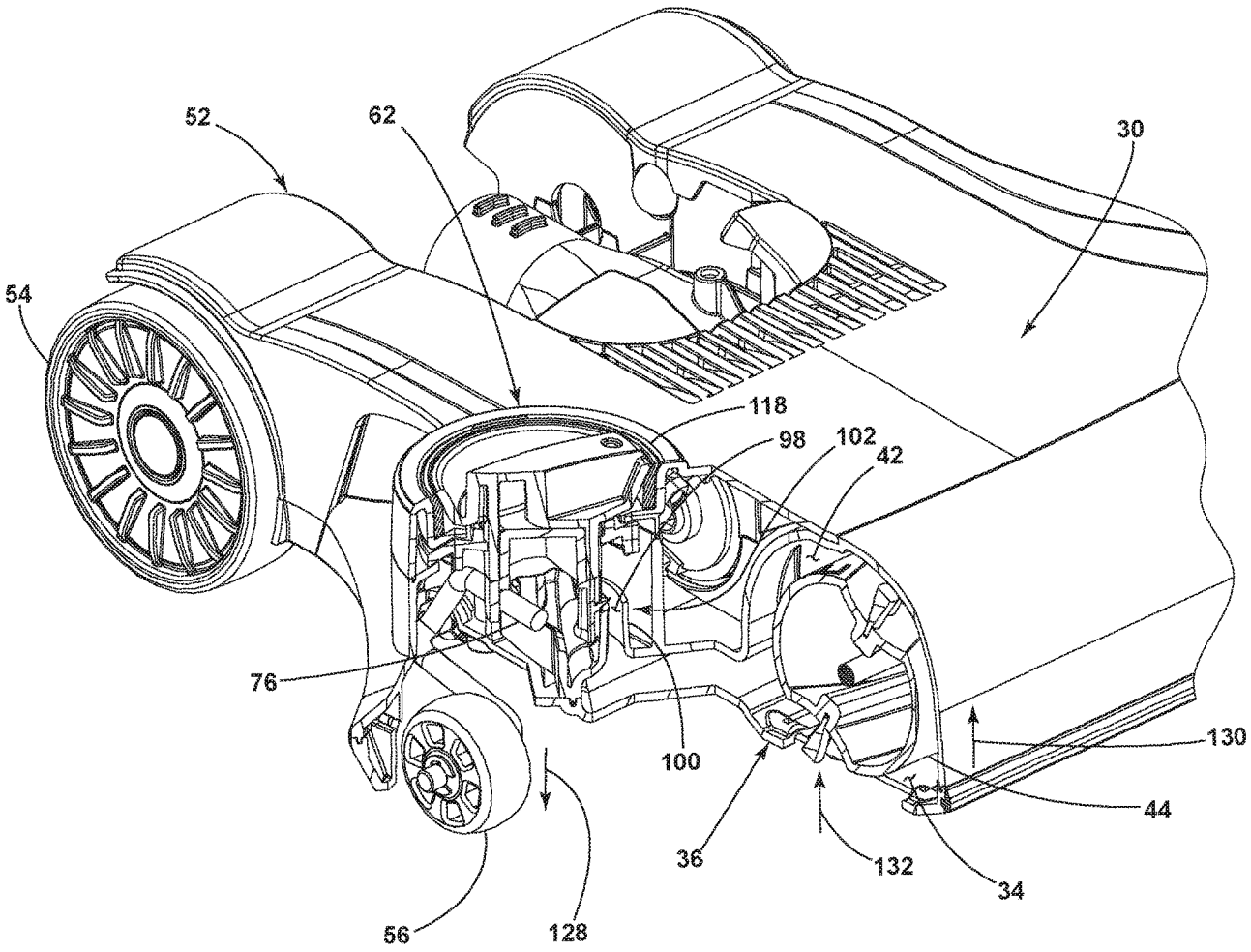
FIG. 6 is a view similar to FIG. 5, with the bleed valve in an open position.

The wheeled carriage 60 can include an elongated support 64 that is pivotable with respect to the base 14 and which carries the front wheels 56 at either end thereof. The support 64 can be mounted on the bottom of the sole plate 36, such as within a carriage receiver 66, and secured by at least one fastener 68 (FIG. 5-6). The carriage receiver 66 can be provided as one or more molded cavities in the sole plate 36 and the fastener 68 can be provided as one or more brackets affixed by screws to the base 14.

The support 64 comprises a laterally-extending carriage axle 70 on which the carriage 60 pivots, and two forwardly-extending arms 72 at either end of the carriage axle 70. The arms 72 have outturned ends which form wheel axles 74 for the front wheels 56. The wheel axles 74 can be substantially parallel to the carriage axle 70, such as by being within 5 degrees or less of the carriage axle 70.

A knob-engaging cam follower 76 is provided on the carriage 60 and will translate upwardly or downwardly as the height of the suction nozzle 32 is adjusted relative to a surface to be cleaned, thereby pivoting the wheeled end of the carriage 60 upwardly or downwardly about the carriage axle 70. In the illustrated embodiment, the cam follower 76 is provided as a finger that extends upwardly from the support 64 and engages a portion of the knob 62.

The knob 62 can be rotated to raise and lower the nozzle inlet 34 and agitator 44 in the agitator chamber 42 through a variety of height settings, including between a low pile or low nozzle height setting in which the nozzle inlet 34 is nearest to the surface to be cleaned and a high pile or high nozzle height setting in which the nozzle inlet 34 is farthest from the surface to be cleaned. Optionally, one or more intermediate nozzle height settings can be provided between the low and high nozzle height settings.

The knob 62 comprises a cylindrical body 78 having a handle 80 on an upper end thereof for the user to grip and a cam 82 at a lower end thereof, which is in engagement with the cam follower 76 on the carriage 60. The cam 82 can have a stepped cam profile 86 on a lower end thereof. The stepped cam profile 86 includes a plurality of incremental steps. The incremental steps have a height difference between adjacent steps, with the height difference corresponding to the height change of the nozzle inlet 34 between settings. The cam profile 86 can be formed with a stop 88 at either extreme of rotation to limit the movement of the knob 62 between the low and high nozzle height settings. Adjacent one of the stops 88 is a step 90 corresponding to the low nozzle height setting, and adjacent the other stop 88 is a step 92 corresponding to the high nozzle height setting. Optionally, one or more intermediate steps 94 can be provided between the low and high steps 90, 92, corresponding to one or more intermediate nozzle height settings The height of the nozzle inlet 34 and the agitator 44 can be adjusted relative to the surface to be cleaned by rotating the height adjustment knob 62 in either direction, i.e. clockwise or counterclockwise. As the knob 62 is rotated, the cam 82 rotates relative to the cam follower 76, and the stepped cam profile 86 moves such that the cam follower 76 engages an adjacent incremental step on the knob 62, which may be higher or lower than the previous step, depending on the direction of rotation. In this way, the height of the nozzle inlet 34 and the agitator 44 can be adjusted up or down, from the low nozzle height setting shown in FIG. 5 to the high nozzle height setting shown in FIG. 6.

With additional reference to FIGS. 5-6, the vacuum cleaner 10 further includes a bleed valve 102 integrated with the height adjustment assembly 58 and configured to selectively open or close to decrease or increase the suction force at the nozzle inlet 34. The bleed valve 102 can be integrated with the knob 62 such that rotation of the knob 62 between different height settings will automatically open or close the bleed valve 102.

The bleed valve 102 can include a valve body 96 positioned to selectively open and close a leak hole 98 in the base housing 30. In the illustrated embodiment, the valve body 96 comprises a flange 96 included on the knob 62, and formed partially around the perimeter of the body 78. The flange 96 is positioned to selectively cover or uncover the leak hole 98. The leak hole 98 is formed at the top of a bleed conduit 100 that is in register with the bottom of the flange 96 and fluidly connected to the working air path, which is partially formed by the nozzle inlet 34 and suction channel 38 of the base 14. The flange 96, leak hole 98, and bleed conduit 100 can define the bleed valve 102. Other configurations of a bleed valve 102 that increases or decreases suction force and that are incorporated with the height adjustment assembly 58 are also possible. The flange 96 may have angled or ramped ends 104, such that the flange 96 will wedge up and over the end of the bleed conduit 100 when moving relative to the bleed conduit 100. The flange 96 may also comprise a gasket designed to enhance the seal between the flange 96 and the bleed conduit 100. As the flange 96 is provided on the knob 62, the handle 80 on the knob 62 functions as a common actuator for the height adjustment assembly 58 and the bleed valve 102.

The leak hole 98 and conduit 100 be arcuate in shape, such that the flange 96 can be rotated over a varying percent of the leak hole 98 (i.e. 0%, 100%, and percentages in between). Other shapes for the flange 96 and leak hole 98 are possible. It is noted that while the height adjustment assembly 58 includes discrete steps for discrete height settings and bleed settings, height adjustment assembly 58 can also be configured to be infinitely adjustable between the lowest and highest settings.

The bleed conduit 100 defines the leak hole 98 at a top end thereof, which forms an outlet opening for the bleed conduit 100, and also defines an inlet opening 106 (FIG. 7-8) through the base housing 30 at a bottom end thereof, opposite the top end. In the illustrated embodiment, the inlet opening 106 is covered by the sole plate 36 of the base 14, and will communicate with ambient air via at least one of the wheel openings 108 in the sole plate 36 that are aligned with the wheels 56 on the carriage 60. Alternatively, a dedicated opening in the sole plate 36 can be provided for communicating ambient air with the bleed conduit 100. It is noted that the bleed valve 102 is provided within the working air path between the nozzle inlet 34 and the base conduit 40, such that the bleed valve 102 is upstream of the dirt separating and collection assembly 26 and the vacuum fan/motor assembly 22 (FIG. 1).

A mount 110 for the knob 62 is provided within the base 14 and affixes the knob 62 to the base housing 30 in alignment with the carriage 60. A corresponding aperture 112 for the knob handle 80 is provided in the cover housing 52 and is surrounded by an annular boss 114.

In one embodiment, the knob 62 can have a light assembly 116 which illuminates around the perimeter of the knob 62. The light assembly 116 includes a light ring 118 in the form of a trim piece that encircles the knob 62 around the handle 80. The light ring 118 is coupled with a LED board 120 that includes one or more LEDs. The light ring 118 forms a light pipe that conducts light from LEDs mounted on the board 120 to the exterior of the vacuum cleaner 10. When the vacuum cleaner 10 is energized, light is emitted through the top of the light ring 118, between the annular boss 114 and perimeter of the knob 62.

FIGS. 5 and 6 are partial cutaway views through the nozzle height adjustment assembly 58 in the base 14, showing the bleed valve 102 in a closed position and an open position, respectively. As the flange 96 is provided on the knob 62, moving the knob 62 to change the nozzle height setting will also change the suction force at the nozzle inlet 34. The bleed valve 102 is integrated with the height adjustment assembly 58 such that when the height adjustment assembly 58 is in the low nozzle height setting shown in FIG. 5, the bleed valve 102 is closed, with the flange 96 covering the entire leak hole 98. In the low nozzle height setting, the carriage wheels 56 are moved closer to the base housing 30, as indicated by arrow 122, which moves the nozzle inlet 34 downward or closer to the surface to be cleaned, as indicated by arrow 124. As shown in FIG. 5, the flange 96 is configured to block the leak hole 98 when the knob 62 is positioned in at least the low pile or low nozzle height setting, thus producing maximum suction through the nozzle inlet 34, as indicated by arrows 126.

Conversely, as shown in FIG. 6, the flange 96 is configured to open and completely unblock the leak hole 98 in at least the high pile or high nozzle height setting, which reduces suction at the nozzle inlet 34. In the high nozzle height setting, the carriage wheels 56 are moved downwardly or farther from the base housing 30, as indicated by arrow 128, which moves the nozzle inlet 34 upward or farther from the surface to be cleaned, as indicated by arrow 130. When the leak hole 98 is opened, ambient air from within the base housing 30 is drawn through the bleed valve 102, specifically though the bleed conduit 100, into the working air path, thereby reducing lift or suction at the nozzle inlet 34, as indicated by arrow 132, which prevents nozzle lock down. Thus, when the height adjustment assembly 58 is in the high nozzle height setting shown in FIG. 6, the bleed valve 102 is fully open, with the entire leak hole 98 uncovered.

At other settings in between the low and high settings, such as when the height adjustment assembly 58 is in one of the intermediate settings corresponding to one of the intermediate steps 94, the bleed valve 102 may be configured to open or close, or be partially open. For instance, as shown in the embodiment illustrated herein, the bleed valve 102 can be configured to gradually open as nozzle height and carpet pile settings increase. Alternatively, the bleed valve 102 can open on one particular setting, such as a dedicated super soft carpet setting. In either case, the maximum bleed or leak occurs at the maximum nozzle height or carpet pile setting. In the embodiment illustrated herein, when the height adjustment assembly 58 is in one of the intermediate settings corresponding to one of the intermediate steps 94, the bleed valve 102 is partially open, with the flange 96 covering a portion of the leak hole 98 and another portion of the leak hole 98 being uncovered.

Figure 7:
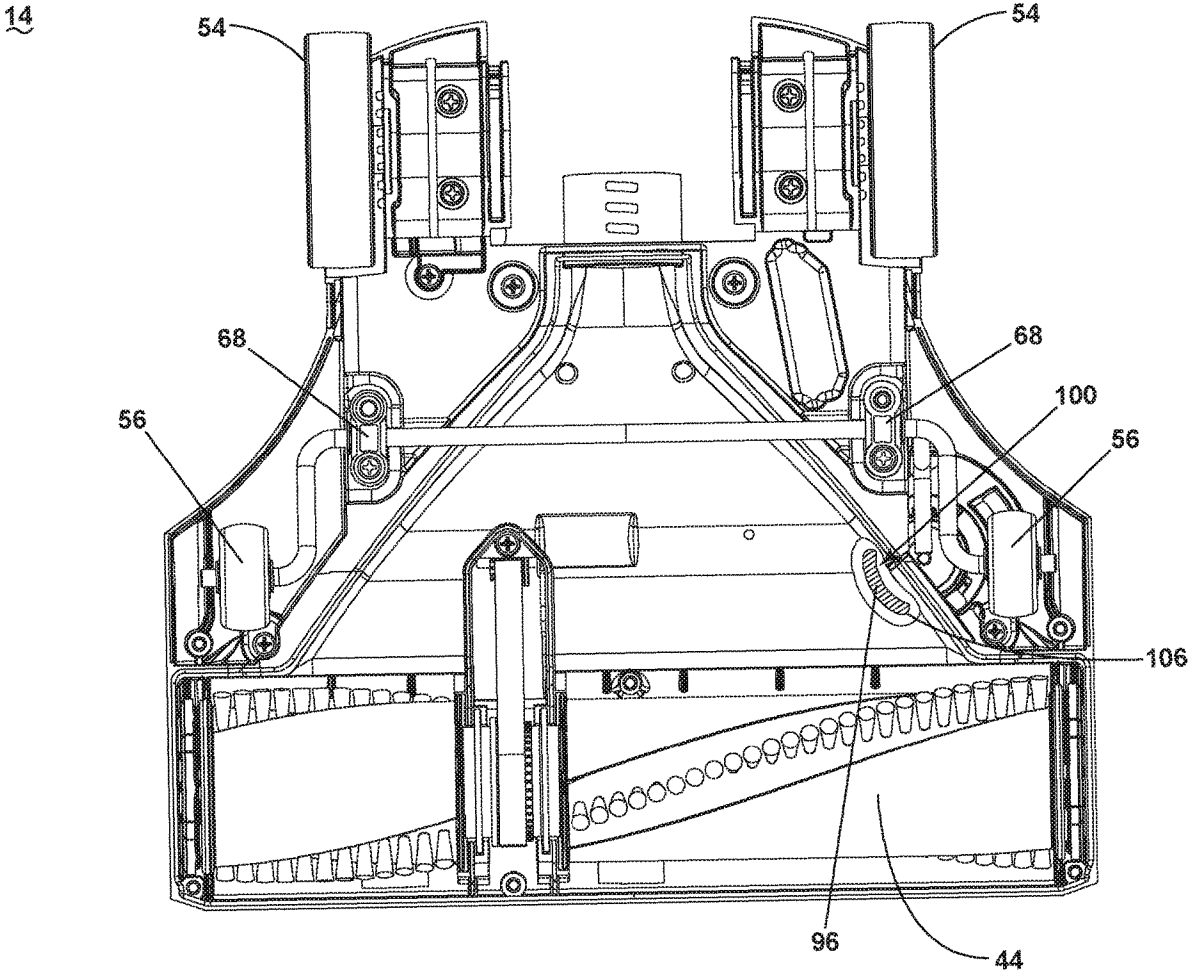
FIG. 7 is a bottom view of the base, with the bleed valve in the closed position and the sole plate is removed from the base for clarity.
Figure 8:
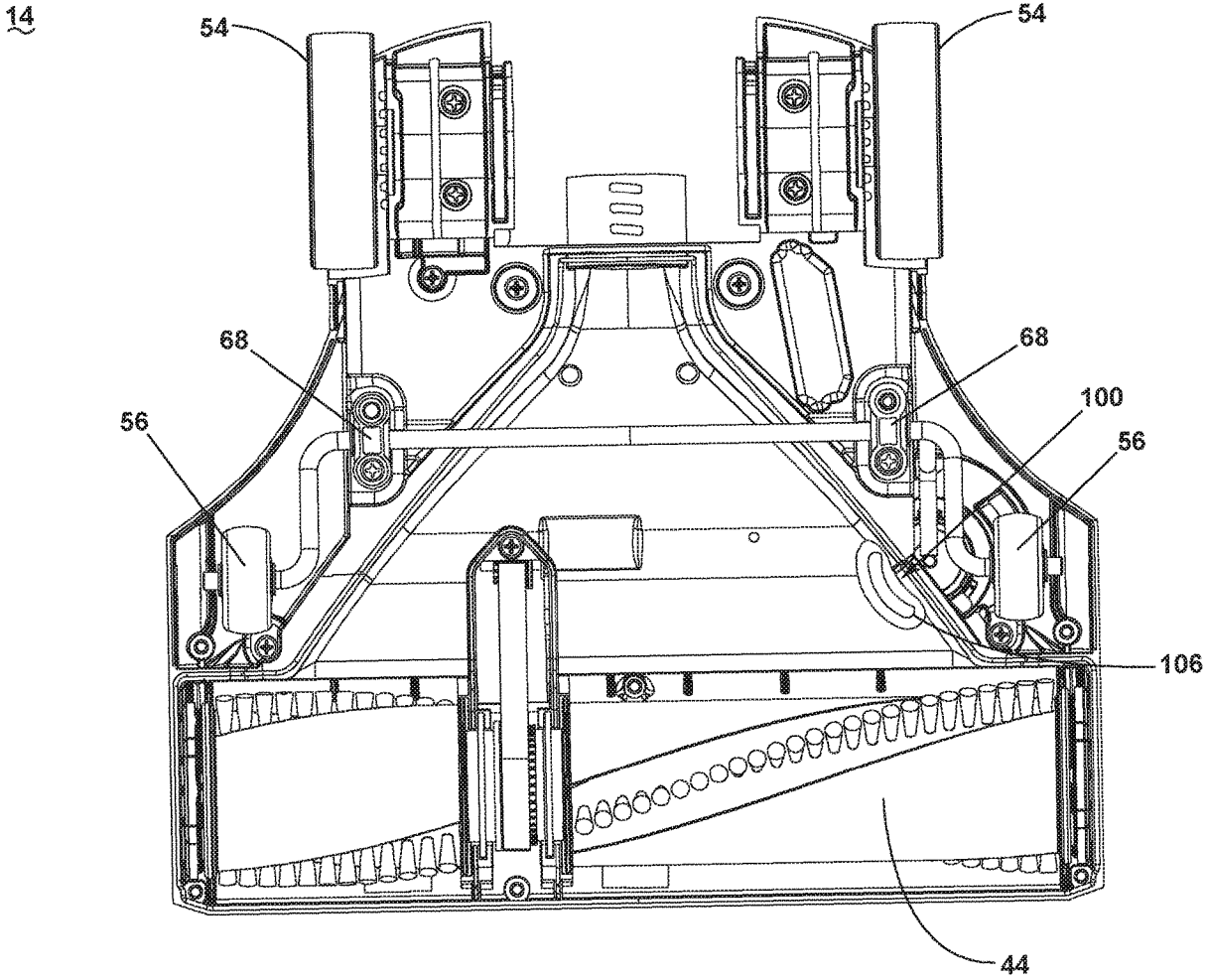
FIG. 8 is a view similar to FIG. 7, with the bleed valve in the open position.

FIGS. 7 and 8 are bottom views of the base 14, showing the bleed valve 102 in a closed position and an open position, respectively. In both figures, the sole plate 36 is removed from the base 14 for clarity. In the closed position shown in FIG. 7, the leak hole 98 is blocked by the flange 96 on the height adjustment knob 62, such that ambient air will not be drawn in through the bleed valve inlet opening 106. In the open position shown in FIG. 8, the leak hole 98 is not blocked by the flange 96, such the leak hole 98 is open or exposed by the flange 96 on the height adjustment knob 62, and ambient air will be drawn into the bleed conduit through the inlet opening 106.

In the illustrated embodiment of the bleed valve 102, no or substantially no ambient air is drawn into the working air path via the valve 102 in the closed position shown in FIGS. 5 and 7. It is noted that, in some cases, a small amount of ambient air may be drawn into the working air path when the bleed valve 102 is closed, due to part tolerances or minor misalignments of the valve components. However, in this case, the small amount of ambient air will not substantially effect suction at the suction nozzle 32.

While the invention has been specifically described in connection with certain specific embodiments thereof, it is to be understood that this is by way of illustration and not of limitation. Reasonable variation and modification are possible with the scope of the foregoing disclosure and drawings without departing from the spirit of the invention which, is defined in the appended claims. Hence, specific dimensions and other physical characteristics relating to the embodiments disclosed herein are not to be considered as limiting, unless the claims expressly state otherwise.

What is claimed is:

1. A vacuum cleaner, comprising:
- a working air path that extends from an air inlet to an air outlet;
- a suction nozzle having a nozzle inlet defining the air inlet;
- a suction source configured to generate a working airstream through the working air path;
- a manual nozzle height adjustment assembly for adjusting the height of the nozzle inlet relative to a surface to be cleaned, and comprising a rotatable knob for manually actuating the nozzle height adjustment assembly to adjust the height of the nozzle inlet relative to the surface to be cleaned; and
- a bleed valve fluidly connected to the working air path and comprising:
  - a leak hole in fluid communication with ambient air; and
  - a valve body configured to selectively cover or uncover the leak hole, wherein when the valve body uncovers the leak hole, the leak hole is in fluid communication with the working air path and suction at the nozzle inlet is reduced; and
- wherein the valve body is provided on the knob of the nozzle height adjustment assembly and wherein rotation of the knob will move the valve body to cover or uncover the leak hole.

2. The vacuum cleaner of claim 1, wherein the manual nozzle height adjustment assembly is moveable between at least a low nozzle height setting in which the nozzle inlet is nearest to the surface to be cleaned and the valve body is positioned to cover the leak hole, and a high nozzle height setting in which the nozzle inlet is farthest from the surface to be cleaned and the valve body is positioned to uncover the leak hole.

3. The vacuum cleaner of claim 2, wherein the manual nozzle height adjustment assembly includes at least one intermediate height setting between the low nozzle height setting and the high nozzle height setting, and wherein the valve body is positioned to partially cover the leak hole in the at least one intermediate height setting.

4. The vacuum cleaner of claim 1, wherein the bleed valve and the nozzle height adjustment assembly share a common actuator.

5. The vacuum cleaner of claim 4, wherein the common actuator is a handle on the knob.

6. The vacuum cleaner of claim 1, wherein the valve body comprises a flange extending from the knob.

7. The vacuum cleaner of claim 6, wherein the flange is integral with the knob for movement with the knob as the knob is rotated.

8. The vacuum cleaner of claim 1, wherein the knob comprises a cylindrical body, and the valve body comprises a flange extending radially from the cylindrical body.

9. The vacuum cleaner of claim 8, wherein the leak hole is arcuate in shape.

10. The vacuum cleaner of claim 1, wherein the bleed valve further comprises a bleed conduit having an inlet end and an outlet end, and defining the leak hole at the outlet end, wherein the valve body is in register with the outlet end of the bleed conduit.

11. The vacuum cleaner of claim 1, wherein the manual nozzle height adjustment assembly further comprises a wheeled carriage configured to lift and lower the nozzle inlet and relative to the surface to be cleaned.

12. The vacuum cleaner of claim 11, wherein the manual nozzle height adjustment assembly further comprises:
- a cam provided on the knob, below the valve body;
- a cam follower provided on the wheeled carriage in engagement with the cam on the knob; and
- wherein rotation of the knob moves the cam relative to the cam follower and the valve body relative to the leak hole.

13. The vacuum cleaner of claim 1, and further comprising a base and an upright assembly pivotally mounted to the base, wherein the suction nozzle and the manual nozzle height adjustment assembly are provided on the base.

14. The vacuum cleaner of claim 13, wherein the base comprises a base housing, and the leak hole is in fluid communication with an opening in a bottom side of the base housing.

15. A vacuum cleaner, comprising:

a working air path that extends from an air inlet to an air outlet;

a suction nozzle having a nozzle inlet defining the air inlet;

a suction source configured to generate a working airstream through the working air path;

a manual nozzle height adjustment assembly for adjusting the height of the nozzle inlet relative to a surface to be cleaned, and comprising a rotatable knob for manually actuating the nozzle height adjustment assembly to adjust the height of the nozzle inlet relative to the surface to be cleaned; and a bleed valve fluidly connected to the working air path and configured to selectively open to reduce suction at the nozzle inlet;

wherein the bleed valve is integrated with the knob of the nozzle height adjustment assembly and wherein the knob is operable to selectively open the bleed valve to reduce suction at the nozzle inlet upon rotation of the knob to adjust the height of the nozzle inlet relative to the surface to be cleaned.

16. The vacuum cleaner of claim 15, wherein the manual nozzle height adjustment assembly is moveable between at least a low nozzle height setting in which the nozzle inlet is nearest to the surface to be cleaned and the bleed valve is closed, and a high nozzle height setting in which the nozzle inlet is farthest from the surface to be cleaned and the bleed valve is open.

17. The vacuum cleaner of claim 15, wherein the bleed valve and the nozzle height adjustment assembly share a common actuator comprising a handle on the knob.

18. The vacuum cleaner of claim 15, wherein the bleed valve further comprises a bleed conduit having an inlet end and an outlet end, and wherein a portion of the bleed valve provided on the knob is in register with the outlet end of the bleed conduit.

19. The vacuum cleaner of claim 15, and further comprising a base and an upright assembly pivotally mounted to the base, wherein the suction nozzle and the manual nozzle height adjustment assembly are provided on the base, and wherein the base further comprises a leak hole in fluid communication with ambient air.

20. The vacuum cleaner of claim 19, wherein the manual nozzle height adjustment assembly further comprises:

a wheeled carriage configured to lift and lower the nozzle inlet and relative to the surface to be cleaned;

a cam provided on the knob;

a cam follower provided on the wheeled carriage in engagement with the cam on the knob; and wherein rotation of the knob moves the cam relative to the cam follower and relative to the leak hole.

* * * * *